US007754956B2

(12) United States Patent
Gain et al.

(10) Patent No.: US 7,754,956 B2
(45) Date of Patent: Jul. 13, 2010

(54) PROGRAMMABLE SYSTEM TO INTEGRATE GENERATED SIGNALS WITH SIGNALS FROM A MUSICAL INSTRUMENT

(75) Inventors: Paul R. Gain, Jacksonville, FL (US); Gregory V. Vance, Baroda, MI (US)

(73) Assignee: Force Ten International LLC, Jacksonville, FL (US)

( * ) Notice: Subject to any disclaimer, the term of this patent is extended or adjusted under 35 U.S.C. 154(b) by 69 days.

(21) Appl. No.: 11/954,756

(22) Filed: Dec. 12, 2007

(65) Prior Publication Data

US 2009/0151542 A1 Jun. 18, 2009

(51) Int. Cl.
*G10H 1/00* (2006.01)
*G10H 1/18* (2006.01)

(52) U.S. Cl. ..... 84/615; 84/610; 84/618; 84/634; 84/653; 84/666

(58) Field of Classification Search ..... None
See application file for complete search history.

(56) References Cited

U.S. PATENT DOCUMENTS 4,175,462 A 11/1979 Simon
4,275,268 A 6/1981 Takahashi et al.
4,817,486 A 4/1989 Saunders
5,565,471 A * 10/1996 Ozaki ..... 514/312
6,215,055 B1 4/2001 Saravis
6,640,257 B1 * 10/2003 MacFarlane ..... 710/1
6,686,530 B2 2/2004 Juszkiewicz et al.
6,839,441 B1 1/2005 Powers et al.
6,995,311 B2 * 2/2006 Stevenson ..... 84/737
7,115,810 B2 10/2006 Ambrosino
7,130,435 B1 10/2006 Toda et al.
7,139,625 B2 11/2006 Aiso et al.
7,145,070 B2 12/2006 Barry
7,164,772 B2 1/2007 Aoki et al.
7,420,112 B2 * 9/2008 Juszkiewicz et al. ..... 84/600
2004/0182230 A1 9/2004 Vlant et al.
2005/0056142 A1 3/2005 Mapleston et al.
2005/0077843 A1 4/2005 Benditt
2007/0256549 A1 11/2007 Yamada

* cited by examiner

*Primary Examiner*—Marlon T Fletcher
(74) *Attorney, Agent, or Firm*—Pattric J. Rawlins; Procopio Cory Hargreaves & Savitch LLP

(57) ABSTRACT

A programmable system for integrating signals in a musical instrument including a programmable device that is configured to create re-callable scenes, where the scenes are representations of audio signals generated by signal devices. The programmable system also includes a plurality of input/output modules to couple the signal devices and the musical instrument to the programmable device. Also included in the programmable system is a memory to store the scenes and a switch to change the combination of audio signals that go in and out of the signal path of the musical instrument by switching scenes.

21 Claims, 6 Drawing Sheets

PROGRAMMABLE SYSTEM TO INTEGRATE GENERATED SIGNALS WITH SIGNALS FROM A MUSICAL INSTRUMENT

FIELD OF THE INVENTION

This invention relates to certain new and useful improvements to a musical system and more particularly to a programmable system which incorporates multiple signal sources.

BACKGROUND OF THE INVENTION

The use of sound effects generated in conjunction with music from a musical instrument has become quite popular. Examples of sound effects which can be generated include distortion, fuzz, overdrive, chorus, reverberation, wah-wah, flanging, phaser or pitch shifting. The devices that generate these sounds may be referred to as sound effect generators or more broadly as signal processing/altering devices or audio components. These devices have also been referred to as an effects pedal or a stomp box because they generally implemented in conjunction with a pedal board, for example, that have large on/off switches on top that are activated using the foot. There are a variety of sound effect generators that are operated by the players of musical instruments in conjunction with the playing of the instruments to generate a desired sound effect along with the music. A sound effect generator can be used in conjunction with a flat board, pedal board or panel which serves as a container, patch bay and power supply for the effects pedals. Some pedal boards contain their own transformer and power cables, in order to power up multiple different effects pedals. Sound effect generators can assist the musician in creating multiple sound effects by using particular combinations of the sound effect generators. Some sound effect generators, such as wah-wah or volume pedals, employ what is known as an expression pedal, which is manipulated while in operation by rocking a large foot-activated (treadle) potentiometer back and forth. Thus, in this case relative position of the expression pedal determines the extent to which the sound is altered.

One problem associated with the use of conventional system stem from the fact that the sound effect generators are typically designed to have the pedals or generators on the floor of the facility in which the musician is playing. After the musician engages one or more of the pedals on one or more occasions, the sound effect generators tend to move and thus, are not in a position where the musician would expect them to be when next required for use. This is particularly a problem when a number of sound effect generators are used in combination. Thus, the logistics of maintaining each of the sound effect generators in a proper position so that the musician knows the location of those pedals by feel is quite complicated.

Another problem with the use of conventional sound effect generators is that switching from one combination of sound effect generators to another combination of sound effect generators involves activating or toggling multiple pedals. FIG. 1, for example illustrates a group of sound effect generators A, B, C and D connected in series with the musical instrument 100. A desire to use particular combinations of the sound effect generators to create the desired sound in the audio output involves multiple switching actions that can be implemented with the bypass activators that increase the complexity of the process. For example if the musician desires to employ sound effect generators B and D, the musician will have to first turn off A, turn on B, then turn Off C and then turn on D. This process can be very tedious especially given the time constraints of switching to a different combination of sound effect generators during a performance by the musician.

What is desired is a way to store different combinations of sound effect generators and allow simple and quick switching between such combinations when desired by the musician.

SUMMARY OF THE INVENTION

A programmable system described herein includes a programmable device used to set up re-callable "scenes" that can control the use of one or more signal sources via electronic switches. The signal sources can include signal processing devices, audio components or any other devices capable of modifying or creating a signal. Generally, the signal sources are used in conjunction with a musical instrument, for example a guitar. Also the signal sources can be used in conjunction with an amplifier where the musical instrument can be connected to an amplifier for amplifying the sounds generated by the musical instrument and for playback on an output device, for example, a speaker. Other examples of musical instruments that use this apparatus include electronic keyboards, electromechanical organs, and the electric bass, vocals, drums or electric violin. In some instances, the sound effects from the signal sources are mixed with the sound from the musical instrument and introduced into other forms of sound generating components or signal sources, such as a tape recorder or a sound track, which may already have other prerecorded music thereon. The scenes can be stored in memory, for example electronic memory banks with battery backup. In one embodiment the programmable system can be used in conjunction with a pedal board. The pedal board can have various options including built in supply, patch bay, AC line filtering, made of plywood or plastic. The programmable system can also be implemented in conjunction with a rack-mount or simply placed on the floor. In another embodiment a programmable interface supports the creation of one or more "scenes" that utilize one or all of the signal sources that can be coupled to the programmable system. The coupling of the signal sources to the programmable can be achieved by a plug or wireless connection, for example. The system can be programmable in the sense that an end-user may store as "scenes" various signal combinations represented by the sound effects of each signal source. In another embodiment the programmable system can provide the ability to switch the various signal source combinations in and or out of the signal path by way of a switching device. The switching device can be a mechanical switch.

As a different scene is selected, the signal from the musical instrument can be modified as a result of the sum of each individual signal source that is programmed to be switched in the signal path as a part of that scene. The switching may be accomplished by toggling a mechanical switch which can be sensed by a microprocessor, for example, that sends the appropriate logic to control an electronic switching array, for example.

The programmable system can incorporate the use of commercially available or custom designed signal sources such as audio components that can be plugged into the programmable system via a standard audio jack or adapter, or via a MIDI interface adapter, for example. The programmable system can also support both stereo and mono input and output. In summary the programmable system provides the end user the ability to set up and select from several signal source combinations at the touch of a single switch, choosing which of the available signal sources will be active for any given scene. These scenes can be created, stored and recalled when desired.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION OF THE DRAWINGS

The following description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the spirit and scope of the present invention.

Figure 1:
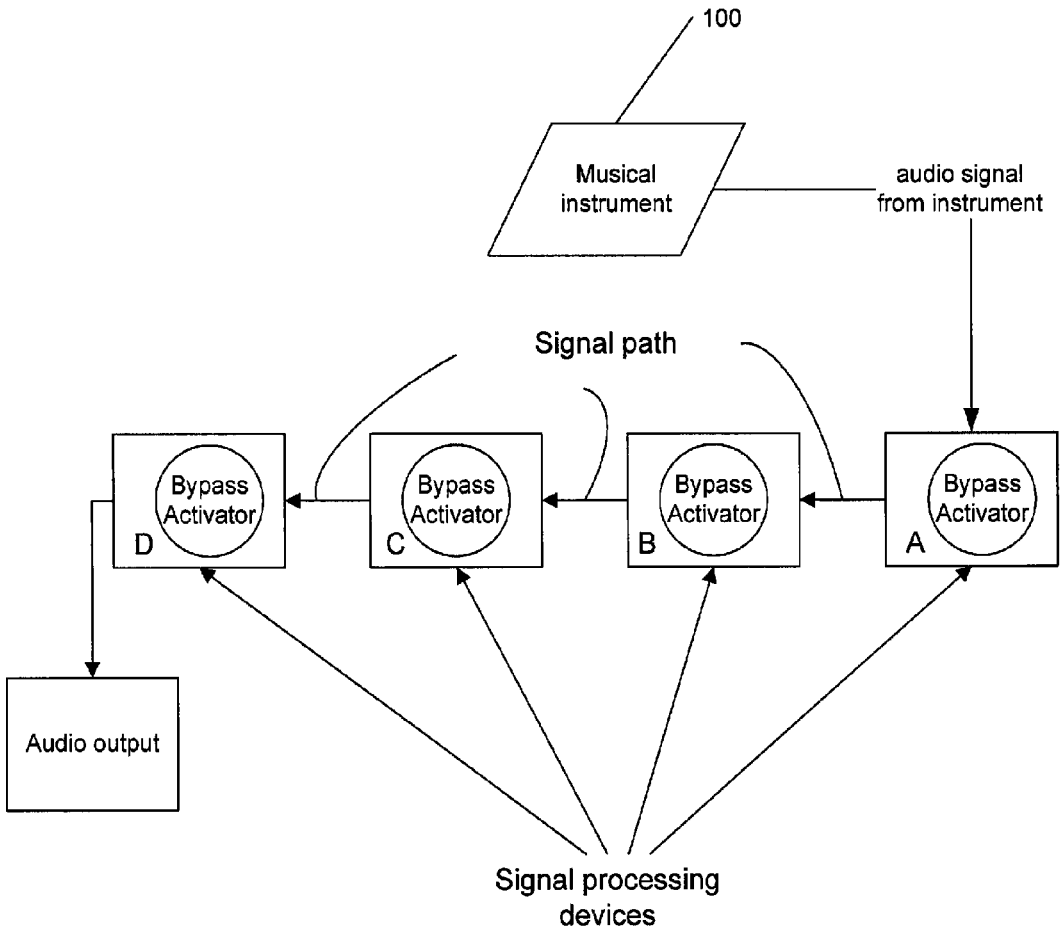
FIG. 1 (Prior Art)
FIG. 1 is a block diagram illustrating a group of signal processing devices A, B, C and D connected in series with the musical instrument.
Figure 2:
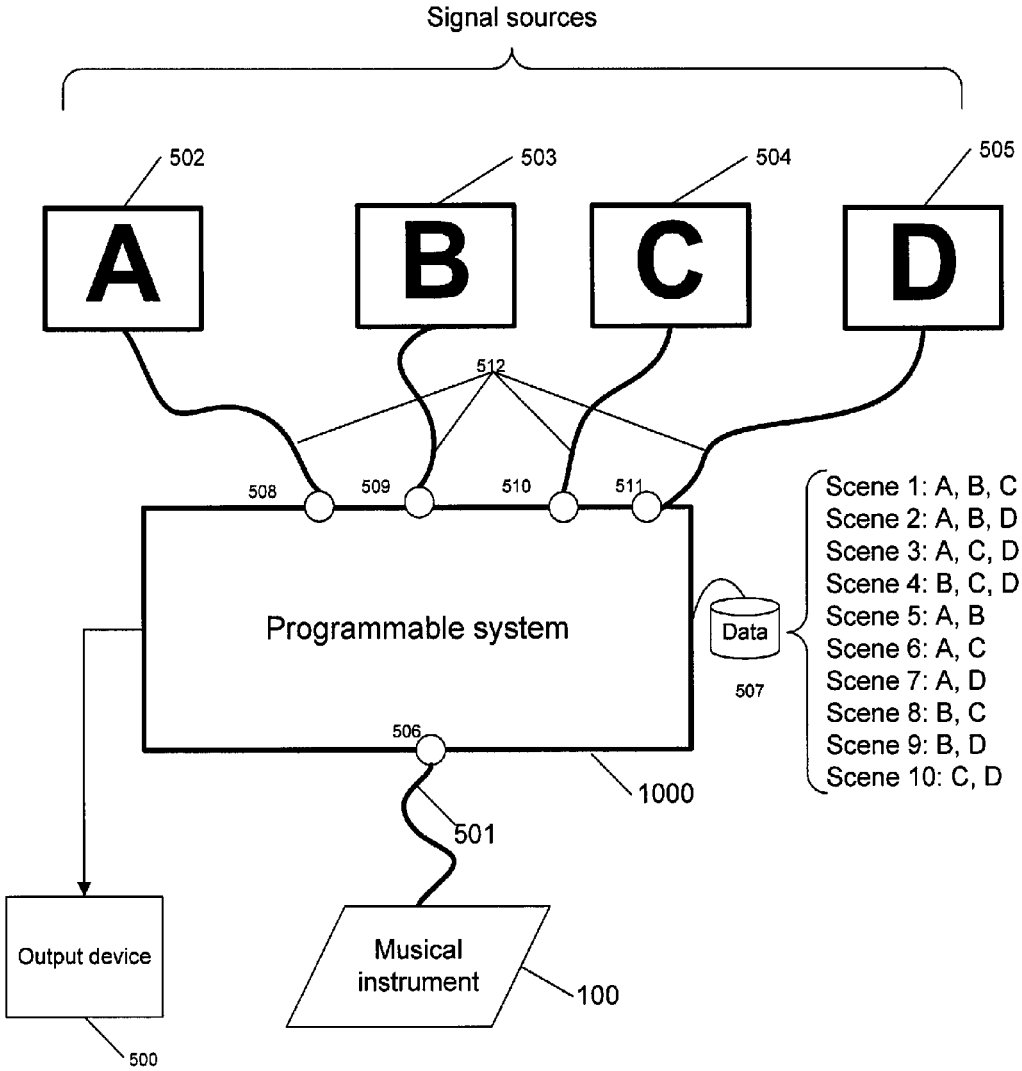
FIG. 2 is a schematic drawing of an exemplary network environment within which embodiments described herein can be implemented.

FIG. 2 is a schematic drawing of an exemplary network environment within which embodiments described herein can be implemented. The network includes a programmable system 1000 that can be configured to create re-callable scenes, for example scene 1 to scene 10 stored in a memory or data storage area 507. In one embodiment the scenes can be configurations of signals from different signal sources, for example, 502, 503, 504 and 505. Examples of signal sources include audio components, signal processing devices or any other devices capable of modifying or creating a signal, for example, a flanger, chorus, rotary speaker, auto-pan etc. The programmable system 1000 can have a plurality of input/output modules 506, 508, 509, 510 and 511 that can be configured to couple the signal sources 502, 503, 504 and 505 and a musical instrument 100 to the programmable system Examples of the musical instrument include a guitar, electronic keyboards, electromechanical organs, electric bass, vocals, drums or an electric violin. In one embodiment the musical instrument 100 and the signal sources can be connected to the programmable system via connectors 501 and 512. In one embodiment the programmable system 1000 can be used in conjunction with a pedal board or a rack-mount. The connector 501 and 512 can include a plug and cable combination that is plugged into, programmable system 100 directly or via a pedal board or rack mount for example. The musical instrument 100 and the signal sources can also be coupled to the programmable system via a wireless connection. In one embodiment, the programmable system can be provided with an internal wiring harness and external jacks for coupling signal sources 502, 503, 504 and 505 to the programmable system. In another embodiment the internal wiring harness and external jacks can be coupled to the programmable system via the pedal board or a rack mount, for example. The musical instrument 100 and the signal sources 502, 503, 504 and 505 can also be wirelessly connected to the programmable system. Also, a sound generating component (not shown), for example, an amplifier, can be coupled to the programmable system 1000 or the musical instrument 100 for amplifying the sounds generated by the musical instrument 100 and the signal sources and for playback on an output device 500. On example of an output device include a speaker.

Figure 3:
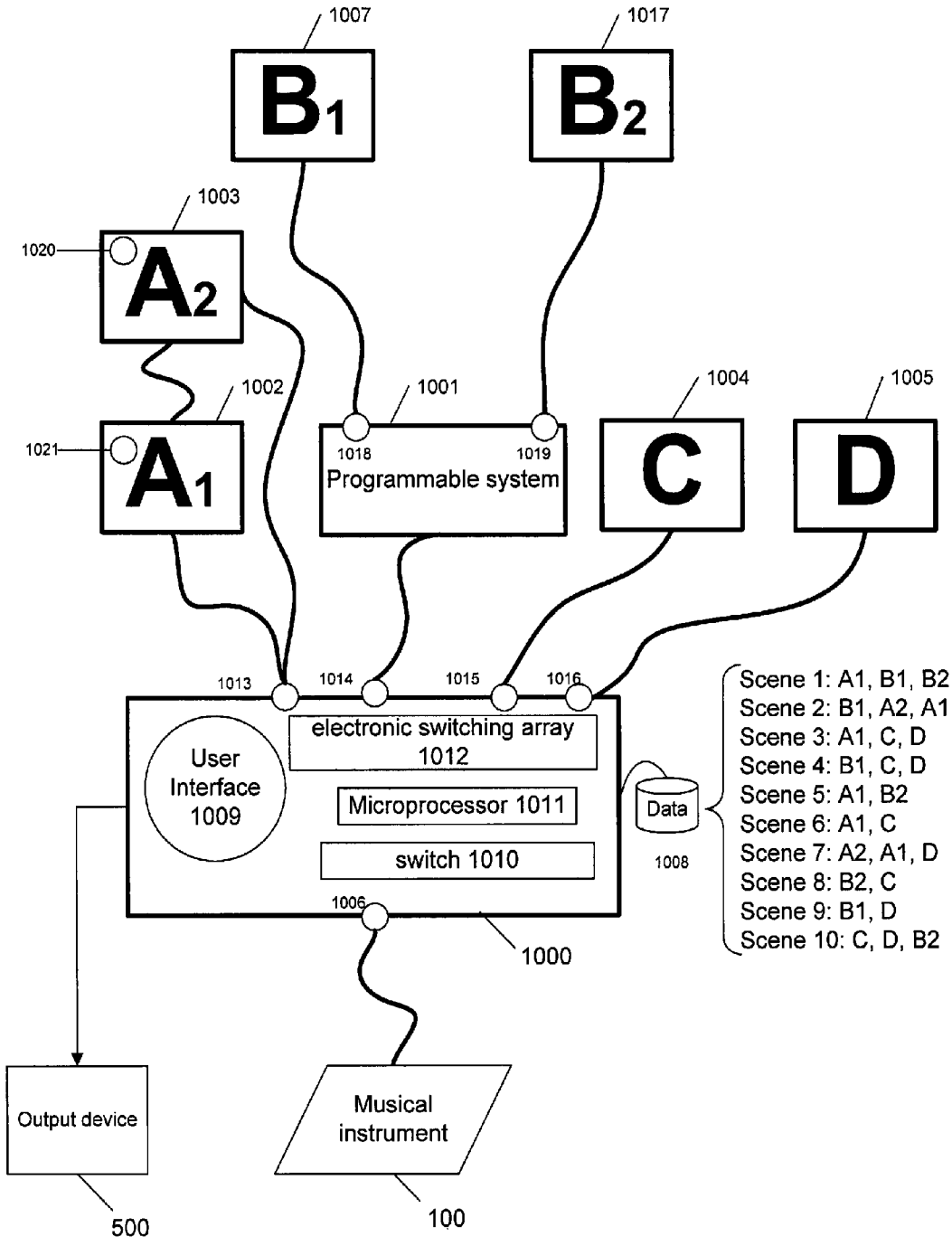
FIG. 3 is a block diagram of an exemplary programmable system configured to control the use of one or more signal sources.

FIG. 3 is a block diagram of an exemplary programmable system configured to control the use of one or more signal sources. In one embodiment, the programmable system 1000 like the one in FIG. 2 above includes a programmable device configured to create re-callable scenes, for example scene 1 to scene 10 stored in a memory or data storage area 1008. The scenes are configurations of signals from different signal sources, for example, 1002, 1003, 1004, 1005, 1007 and 1017. In one embodiment the signal sources 1002 and 1003 can be audio component $A_1$ and $A_2$ that can be serially coupled. In another embodiment, the signal sources C and D can be signal processing devices that can be coupled to the programmable system 1000 as illustrated in FIG. 2 above. A second programmable system 1001 can be coupled to the programmable system 1000. Also the second programmable system 1001 can also be coupled to signal sources 1007 and 1017, where the signal sources can be audio components or signal processing devices. The programmable systems 1000 and 1001 can have a plurality of input/output modules 1006, 1018-1019 and 1013-1016 that are configured to couple the signal sources 1002, 1003, 1004, 1005, 1007 and 1017 and a musical instrument 100 to the programmable systems 1000 and 1001. The programmable system 1000 can also have a memory 1008 to store the different scenes, for example scenes 1-10, such that the scenes are re-callable when desired. The scenes 1-10 can include various configurations of the signal sources coupled to both programmable systems 1000 and 1001. For example scene 1 has a combination of signals from signal source $A_1$ coupled to the programmable system 1000 and signals from signal source $B_1$ and $B_2$ coupled directly to the programmable system 1001 and indirectly to the programmable system 1000. The memory 1008 can be an electronic memory bank and can also be supported by a backup battery. In yet another embodiment the end user is provided with a user interface 1009 that supports the creation of one or more scenes. The scenes 1-10 can utilize one or all of the signal sources 1002-1005, 1007 and 1017 that can be, for example, plugged into the programmable systems 1000 and 1001. The programmable system 1000 can be programmable in the sense that the user can store as scenes 1-10, signals of various signal source combinations with the ability to switch the various combinations of signals from the signal components 1002-1005 in and out of a signal path by means of a single switch 1010. The switch can be, for example, a mechanical switch. In one embodiment, when a different scene is selected a signal generated by the musical instrument is modified as a result of the sum of each signal represented by the selected scene. The switching can be accomplished by toggling the switch 1010 and the toggling can then be sensed by a microprocessor 1011 which can in turn send the appropriate logic to control an electronic switching array 1012, for example, in order to select the appropriate scene. Further the switch 1010 can be incorporated into the user interface 1009. A bypass activator can be implemented in conjunction with the programmable system 1000. However, in some embodiments bypass activators 1021 and 1020 can be included in the signal sources as shown in the case of signal sources $A_1$ and $A_2$. This configuration allows the programmable system to either allow a signal to flow through a signal source or not. The bypass activator can provide true bypass or regular bypass. True bypass includes bypassing the signal source completely whereas regular bypass includes allowing a signal to flow through the signal source without modification.

The programmable system 1000 provides for the use of commercially available or custom designed audio components that can be coupled to the programmable system via an audio jack or adapter. The programmable system 1000 can support both stereo and mono input and output. Accordingly the programmable system 1000 can provide the end user the ability to setup and select a combination of signals from several signal sources 1002-1005, 1007 and 1017 that will be active for any given scene. The scenes 1-10 can be created and stored in memory 1008 for later recall as desired.

Figure 4:
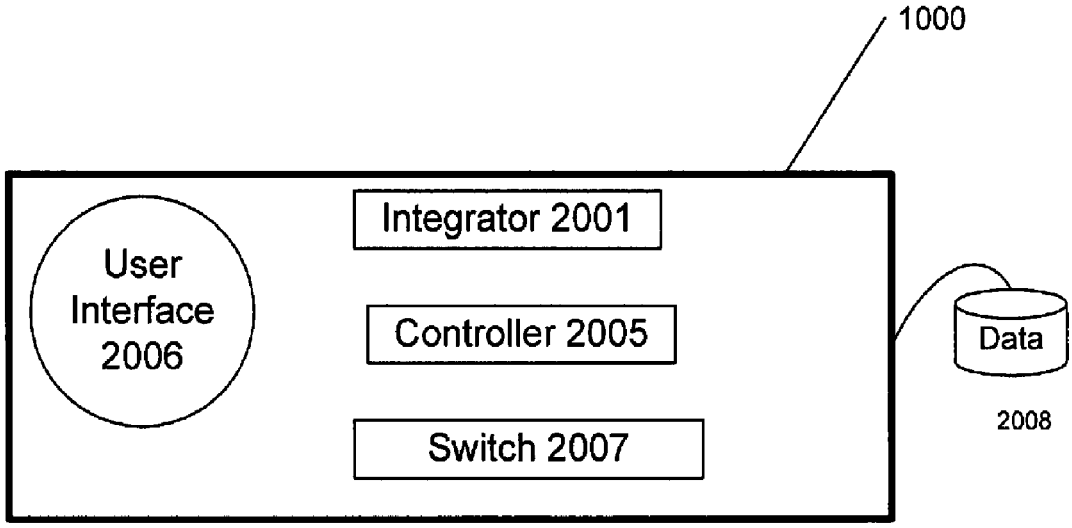
FIG. 4 is a block diagram of another exemplary programmable system to modify signals associated with a musical instrument.

FIG. 4 is a block diagram of an exemplary programmable system to modify signals associated with a musical instrument. In one embodiment, the programmable system 1000 includes an integrator module 2001 that is configured to integrate one or more signals from at least one signal source. In one embodiment, the at least one signal source can be integrated wirelessly or by physically connecting the devices to the programmable system 1000. In another embodiment the at least one signal source can be coupled to the programmable system 1000 via an input/output module that can receive a plug, such that an audio jack or adapter can be plugged into the programmable system 1000. In yet another embodiment a controller module 2005 can be included in the programmable system 1000 to create at least one scene affiliated with one or more integrated signals. The programmable system 1000 can also have a user interface module 2006 to support the creation of the at least one scene by the controller 2005. The user interface 2006 can also provide a user with the option of selecting a scene from a plurality of scenes. When a scene is selected, the one or more signals affiliated with the scene modify the audio signal generated by a musical instrument as a result of the sum of each audio signal represented by the selected scene.

In another embodiment various combinations of signals from multiple signal sources are represented by multiple scenes. The multiple scenes can be stored in memory 2008 so that they can be recalled when desired. A signal switch 2007 can enable switching between the multiple scenes such that the user can select one or more scenes for modifying the signal from the musical instrument. The signal switch 2007 can be sensed by the controller 2005 which in turn sends the appropriate logic to control the switching between the scenes that are stored in a memory 2008. In one embodiment the signal switch 2007 can be an electronic switch or a mechanical switch. The programmable system 1000 can support both stereo and mono input and output.

Figure 5:
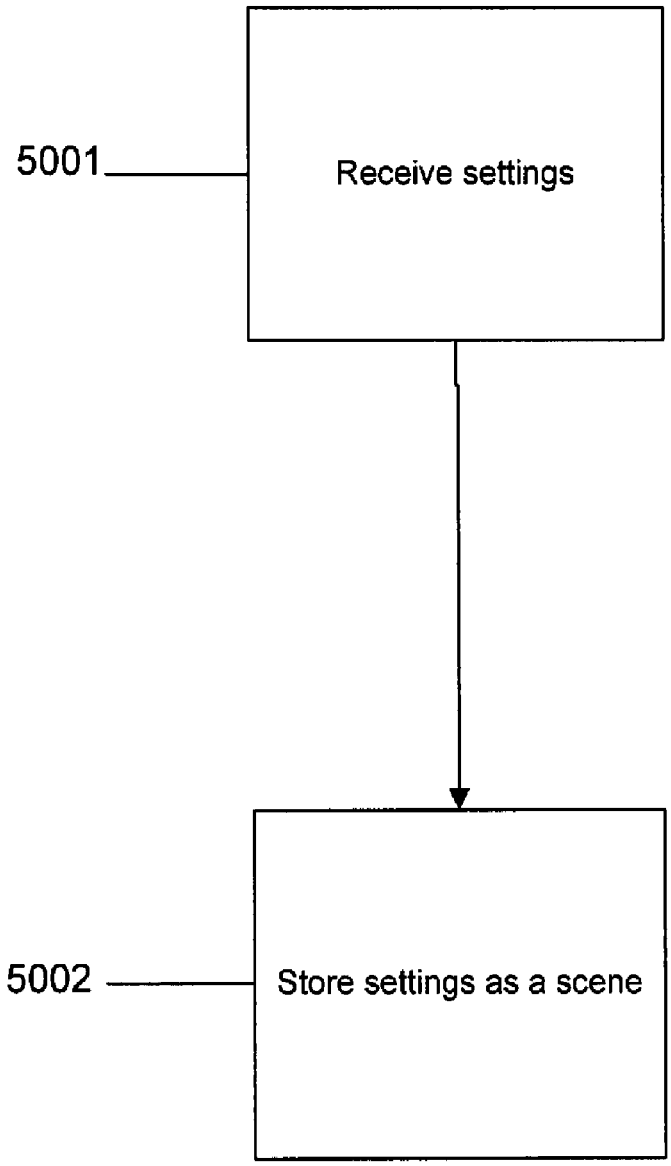
FIG. 5 is a block diagram of an exemplary procedure for creating scenes from signals originating from signal sources.

FIG. 5 is a block diagram of an exemplary procedure for creating scenes from signals originating from signal sources. In step 5001, the procedure starts with receiving settings where the settings can be a configuration of signals generated by one or more signal sources. The procedure then continues to step 5002, where the settings are stored as a scene in memory, for example. Multiple settings can be configured and stored as multiple scenes in memory.

Figure 6:
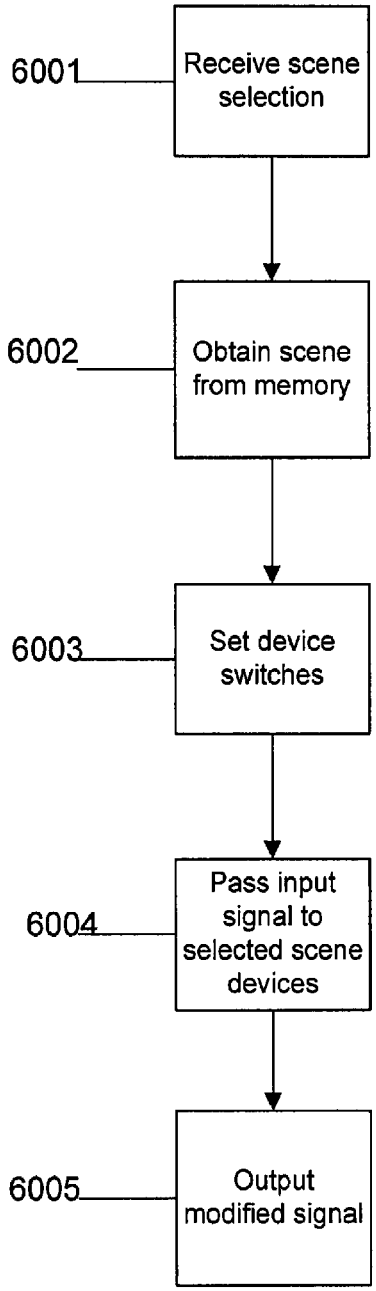
FIG. 6 is a block diagram of an exemplary procedure for modifying signals associated with a musical instrument.

FIG. 6 is a block diagram of an exemplary procedure for modifying signals associated with a musical instrument. In step 6001, the procedure starts by receiving a scene selection. In one embodiment the scene selection can be implemented on a user interface module. A scene can be a configuration of one or more signals originating from one or more signal sources. A user of the programmable system has the capability of selecting a scene to modify the signal generated by a musical instrument. The process then continues to step 6002, where the selected scene is obtained from memory. The device switches can then be set in step 6003 where the device switches can be configured to change the combination of the signals that go in and out of the signal path of the musical instrument. The selection of the at least one or more scenes can be achieved by the activation of a single switch. In step 6004 the input signal from the musical instrument is passed to the selected scene devices. This implementation results in the modification of the signal from the musical instrument. In step 6005, the modified signal is then outputted to an output device, for example, a speaker or any medium where it can be stored for future use.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Those of skill in the art will appreciate that the various illustrative system elements and method steps described in the figure and the embodiments and examples disclosed herein can often be implemented as electronic hardware, software, firmware or combinations of the foregoing. To clearly illustrate this interchangeability of hardware and software, various illustrative modules and method steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a system element or step is for ease of description. Specific functions can be moved from one element or step to another without departing from the invention.

A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

Although the steps/operations of the method(s) herein are shown and described in a particular order, the order of the steps/operations of each method may be altered so that certain steps/operations may be performed in an inverse order or so that certain steps/operations may be performed, at least in part, concurrently with other operations. In another embodiment, instructions or sub-operations of distinct operations may be in an intermittent and/or alternating manner.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A programmable system for integrating signals in a musical instrument, the programmable system comprising:

a memory;

a programmable module configured to receive input defining a scene, wherein a scene is a combination of signals generated by one or more signal sources, the programmable module further configured to store a plurality of scenes in the memory;

a plurality of input/output modules configured to couple the signal sources and the musical instrument to the programmable module;

a user interface module to receive a selection of a scene; and a switching device configured to change the combination of the signals from the one or more signal sources that affect the signal path of a musical instrument by switching between the plurality of stored scenes in response to the selection.

2. The programmable system of claim 1, wherein the musical instrument is includes one of a sound generating device or sound altering device that generates an electronic audio signal.

3. The programmable system of claim 1, wherein the switching device is a mechanical switch.

4. The programmable system of claim 1, further comprising a module that senses a switch motion and communicates the appropriate logic to a switching array, the switching array being one of an electronic switching array or an electromechanical switching array.

5. The programmable system of claim 4, wherein the one or more signal source is wirelessly coupled to the programmable system.

6. A programmable system configured to integrate signals from at least one signal source with a signal from a musical instrument comprising:

an integrator module configured to integrate one or more signals from at least one signal source;

a controller module configured to create at least one scene, wherein the at least one scene is a configuration of the one or more integrated signals;

a user interface module configured to support the creation of the at least one scene and to select a scene wherein upon selection of the scene, the one or more signals affiliated with the scene modifies the signal from the musical instrument;

a switch configured to change the combination of the signals from the one or more signal sources that affect the signal path of the musical instrument by switching scenes; and a memory to store the at least one scene for recall.

7. The programmable system of claim 6, wherein a backup battery supports the memory.

8. The programmable system of claim 6, wherein the at least one scene is a plurality of scenes associated with the one or more signals.

9. The programmable system of claim 8, wherein multiple switches are configured to switch between the plurality of scenes.

10. The programmable system of claim 8, wherein 2 or more scenes are selected at a time.

11. The programmable system of claim 8, wherein the plurality of scenes is stored in memory.

12. The programmable system of claim 6, wherein the switching device includes one of an electronic switching array or an electromechanical switching array.

13. The programmable system of claim 6, wherein the signal source is a flanger.

14. The programmable system of claim 6, wherein the signal source is a stand-alone effect unit.

15. The programmable system of claim 6, wherein the signal source is a sound effect generator.

16. The programmable system of claim 6, wherein the signal source is multi-effect processor.

17. The programmable system of claim 6, wherein the at least one signal source is coupled to the programmable system.

18. The programmable system of claim 17, wherein the at least one signal source is coupled to the programmable system via at least one plug.

19. The programmable system of claim 17, wherein the at least one signal source is wirelessly coupled to the programmable system.

20. The programmable system of claim 6, wherein the programmable system supports both stereo and mono input and output.

21. A programmable system for integrating signals from a musical instrument, the programmable system comprising:

a memory;

a programmable module configured to receive input defining a scene, the scene identifying a combination of signals generated by one or more signal sources from a plurality of different signal sources connected to the programmable system, the programmable module further configured to store a plurality of defined scenes in the memory;

a plurality of input/output modules configured to couple the plurality of signal sources and the musical instrument to the programmable module; and a user interface module to receive a selection of a scene;

a switch configured to change the combination of the signals from among the plurality of signal sources that affect the signal path of the musical instrument by selecting between one or more of the defined scenes in the memory;

an electronic array, responsive to the switch, that loads the one or more selected scenes to the signal path of the musical instrument.

* * * * *